US007980662B2

(12) United States Patent
Matsumoto

(10) Patent No.: US 7,980,662 B2
(45) Date of Patent: Jul. 19, 2011

(54) INK JET PRINT HEAD

(75) Inventor: Mitsuhiro Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 247 days.

(21) Appl. No.: 12/204,366

(22) Filed: Sep. 4, 2008

(65) Prior Publication Data

US 2009/0066753 A1 Mar. 12, 2009

(30) Foreign Application Priority Data

Sep. 6, 2007 (JP) ..... 2007-231439

(51) Int. Cl.
*B41J 2/14* (2006.01)
*B41J 2/04* (2006.01)

(52) U.S. Cl. ..... 347/47; 347/54

(58) Field of Classification Search ..... 347/61–62, 347/56

See application file for complete search history.

(56) References Cited

U.S. PATENT DOCUMENTS 6,971,736 B2 12/2005 Tomizawa et al.
6,984,026 B2 1/2006 Tomizawa et al.
7,093,334 B2 8/2006 Sobrito
2004/0207692 A1* 10/2004 Yamamoto et al. ..... 347/56
2005/0012791 A1* 1/2005 Anderson et al. ..... 347/85
2008/0055368 A1 3/2008 Oikawa et al.
2008/0239011 A1 10/2008 Ide et al.

FOREIGN PATENT DOCUMENTS

JP 2004-42651 2/2004
JP 2004-42652 2/2004

* cited by examiner

*Primary Examiner* — Matthew Luu
*Assistant Examiner* — Lisa M Solomon
(74) *Attorney, Agent, or Firm* — Fitzpatrick, Cella, Harper & Scinto

(57) ABSTRACT

A reliable ink jet print head enables small ink droplets to be ejected at a high frequency while preventing possible satellites and mist. A bubbling chamber, in which an energy generating element is disposed, communicates, via an ejection port portion, with an ejection port provided opposite the energy generating element. The ejection port portion is formed such that flow resistance to ink is lower in an area of the ejection port portion which is positioned inward from a center of the ejection port in an ink supply direction of ink flowing along the ink supply channel, than in an area of the ejection port portion which is positioned outward from the center of the ejection port.

8 Claims, 9 Drawing Sheets

INK JET PRINT HEAD

BACKGROUND OF THE INVENTION

1. Field of the Invention

The present invention relates to an ink jet print head that ejects ink droplets to print media, and in particular, to an ink jet print head suitable for high-speed and high-definition printing.

2. Description of the Related Art

With the increased operation speed and improved image quality of ink jet printing apparatuses, attempts have been made to reduce the size of droplets ejected from a print head and to increase ejection frequency.

The opening area of each ejection port in the print head needs to be reduced in order to reduce the size of ejected droplets. However, the reduced opening area of the ejection port increases the flow resistance of a liquid in a portion (ejection port portion) that communicates with the ejection port. This may prevent desired ejection performance and efficiency from being obtained. Thus, ink jet print heads are disclosed in Japanese Patent Laid-Open Nos. 2004-042651 and 2004-042652 as a method of reducing the flow resistance of the ejection port portion while maintaining the strength of an ejection port forming portion.

The ink jet print heads disclosed in Japanese Patent Laid-Open Nos. 2004-042651 and 2004-042652 each have a plurality of nozzles through which ink flows. As shown in FIG. 8, each of the nozzles has a supply channel 39 through which ink is supplied, a bubbling (bubble) chamber 38 in which the ink is heated to generate bubbles, and an ejection port portion 36 including an ejection port 37 that is a tip opening of a nozzle through which ink droplets are ejected. The ejection port portion 36 allows the ejection port 37 and the bubbling chamber 38 to communicate with each other and includes a first ejection port portion 36*a* and a second ejection port portion 36*b* that communicate with the ejection port 37. The first ejection port portion 36*a* and the second ejection port portion 36*b* constitute a cylindrical space centered around one central axis S0 passing through the center of an electrothermal conversion element 34 orthogonally to a major surface 32*a* of an element substrate 32. Thus, in the ejection port portion 36, an area R31 located inwardly in an ink supply direction (X direction) and an area R32 located outwardly in the same direction are symmetrical with respect to the central axis S0. Furthermore, if the second ejection port portion 36*b* is cut in a direction parallel to the major surface 32*a*, the resulting opening portion is located outside an opening resulting from cutting of the first ejection port portion 36*a* in the same direction and inside a cross section of the bubbling chamber 38 in the same direction. That is, the second ejection port 36*b* constitutes a space obtained by enlarging the first ejection port portion 36*a* in a plane direction.

In the thus configured ink jet print head 30, the strength of a peripheral portion of the ejection port 37 can be determined based on the thickness of the first ejection port portion 36*a*. Furthermore, the space enlarged by the second ejection port portion 36*b* reduces the flow resistance of the entire ejection port portion. This enables a possible pressure loss in the ejection port portion 36 to be reduced to allow bubbles to grow (expand) in an ejection direction. As a result, the ejection efficiency can be improved.

Furthermore, the amount of time from immediately after ejection until the start of refilling of ink in the bubbling chamber (hereinafter referred to as the refill time) needs to be reduced in order to increase the ejection frequency at which ink droplets are ejected from the ink jet print head. To reduce the refill time, the ink supply channel needs to be designed to have an increased channel width and an increased height to reduce the flow resistance to the ink in the ink supply channel.

However, the following has become clear. The enlarged ink supply channel results in the formation of a large space in the bubbling chamber, composed of a part of the ink supply channel. As a result, fine ink droplets (satellites) are generated which do not contribute to image formation during ejection of ink droplets.

FIG. 9A shows a stage in which, after a main droplet D1 is ejected through the ejection port 37 by means of a bubble B generated by heat from an electrothermal conversion element H, the bubble is eliminated. In FIG. 9A, M denotes a meniscus made up of ink forming the bubble. D2 denotes a trailing portion of the droplet coupled to the meniscus.

As the bubble becomes smaller over time as shown in FIG. 9B, the meniscus is partly ruptured and the bubble starts to communicate with the atmosphere. The trailing portion D2 is coupled to ink positioned outwardly in the channel in the bubbling chamber. Finally, the trailing portion D2 is severed from the ink in the bubbling chamber R to form an ink droplet completely separate from and independent of the ink in the channel.

At this time, if the ink channel is set to have a large volume in order to increase the ink refill speed, the trailing portion D2 becomes long, and the severance of the trailing portion D2 from the ink in the bubbling chamber R is likely to generate a fine droplet (satellite) D3 split from the trailing portion D2. The satellite is emitted though the ejection port to the exterior, where the satellite creates a mist. The ink mist adheres to a print medium, the print head, and unspecified areas in the ink jet printing apparatus main body, posing problems such as degraded print quality or malfunctioning of the printing apparatus. Thus, measures are taken in current ink jet printing apparatuses to overcome this problem. These measures include providing a structure for removing possible static electricity from members to which the ink mist is likely to adhere or avoiding the possible adhesion of the mist. For example, a fan may be installed for preventing the possible residue of the ink mist, or installation of a device that electrostatically sucks ink droplets.

However, taking these measures to collect or remove the ink mist adds extra costs to the product. Thus, fundamental solutions have been required which reduce possible satellites when ink droplets are ejected.

SUMMARY OF THE INVENTION

An object of the present invention is to provide a reliable ink jet print head and a reliable ink jet printing apparatus which enable small ink droplets to be ejected at a high frequency while preventing possible satellites and mist and which also enable high-speed and high-image-quality printing.

The present invention provides an ink jet print head comprising a nozzle having an ink supply channel through which ink is supplied, a bubbling chamber connected to the channel and having an energy generating element disposed therein, and an ejection port portion that allows an ejection port formed opposite the energy generating element to communicate with the bubbling chamber, wherein the ejection port portion is formed such that flow resistance to ink is lower in an area of the ejection port portion which is positioned inward from a center of the ejection port in an ink supply direction of ink flowing along the ink supply channel, than in an area of the ejection port portion which is positioned outward from the center of the ejection port.

In the present invention, when an ink droplet is ejected through the ejection port by means of a bubble generated in the bubbling chamber, a flow from the inward side to the outward side in the ink supply direction occurs in the ink flowing through the ink ejection port portion. A trailing portion of ink that is continuous with a main ink droplet bends rapidly outward in the ink supply direction. As a result, an inner surface of the ejection port portion interferes with the trailing portion, which is thus quickly severed. This reduces the entire length of the ink droplet and thus possible satellites and mist.

Further features of the present invention will become apparent from the following description of exemplary embodiments (with reference to the attached drawings).

DESCRIPTION OF THE EMBODIMENTS

Embodiments of the present invention will be described below in detail with reference to the drawings.

First Embodiment

A first embodiment of the present invention will be described with reference to FIGS. 1A, 1B, 2, and 4.

Figure 1B:
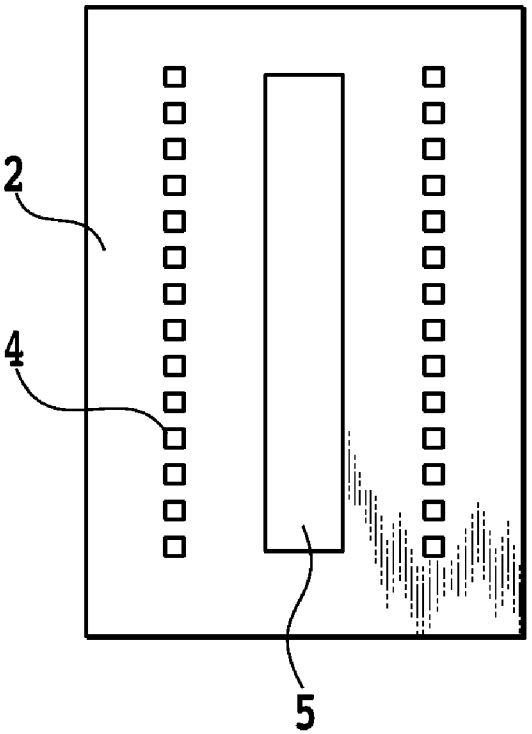
FIG. 1B is a plan view schematically showing an element substrate 2 shown in FIG. 1A.
Figure 1A:
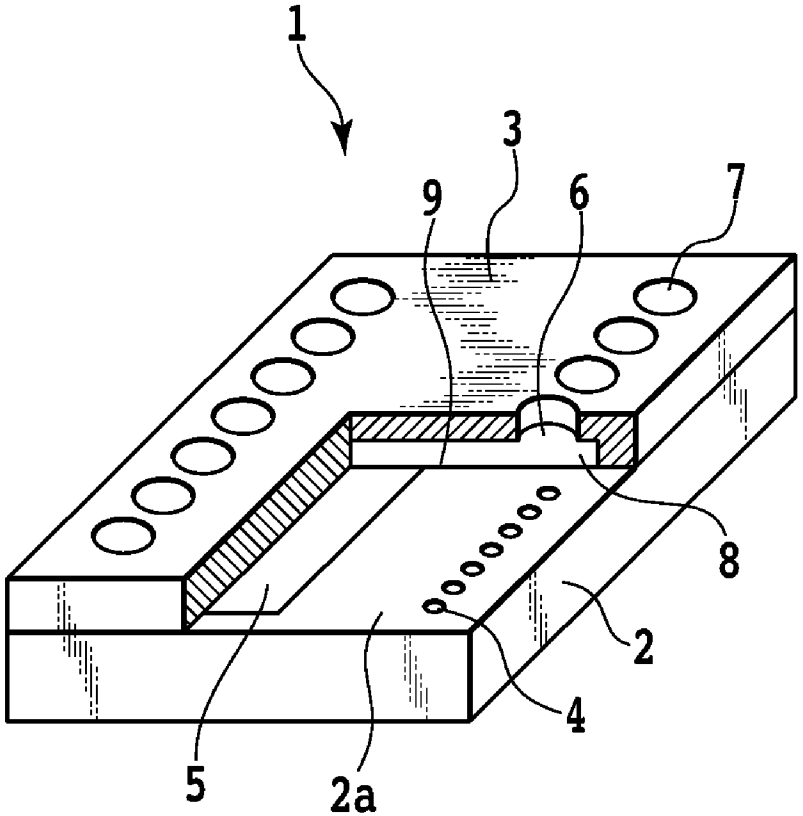
FIG. 1A is a perspective view schematically showing a partly cutaway ink jet print head 1 according to a first embodiment.

FIG. 1A is a perspective view schematically showing a partly cutaway ink jet print head 1 according to the first embodiment. The ink jet print head 1 comprises an element substrate 2 on which an electrothermal conversion element 4 serving as heat energy generating means is provided, and a channel constituting substrate (orifice plate) 3 laminated on a major surface 2*a* of the element substrate 2.

As shown in FIG. 1B, two electrothermal conversion element rows each made up of a plurality of the electrothermal conversion elements 4 are arranged on the element substrate 2 in parallel across an ink supply port 5.

On the other hand, the channel constituting substrate 3 is formed of a plurality of ejection port portions 6, a plurality of bubbling chambers 8 communicating with the respective ejection port portions 6, and a plurality of ink supply channels 9 communicating with the respective bubbling chambers 8. One end of each of the ink supply channels 9 communicates with the ink supply port. Furthermore, each of the ejection port portions 6 has an ejection port 7 at one end thereof which is open formed in the orifice plate 3. Each of the ejection ports 7 is formed opposite a corresponding one of the electrothermal conversion elements 4. Thus, two ejection port arrays are formed on the element substrate 3. The above-described ejection port portion 6, bubbling chamber 8, and ink supply channel 9 constitute the nozzle. In the present invention, ink is not limited to a liquid containing a predetermined color producing reagent to be attached to a print medium to form an image on the print medium but includes a transparent process liquid ejected from the print head before or after image formation in order to improve the coloring capability and weatherability of the image formed on the print medium.

In the print head including the plurality of nozzles formed therein as described above, an ink tank (not shown in the drawings) is connected to the ink supply port 5. The ink in the ink tank is filled into the bubbling chamber 8 and the ejection port portion 6 through the ink supply port 5 via the ink supply channel 9. Then, the electrothermal conversion element 4 is energized to generate heat to instantaneously boil the ink in the bubbling chamber 8. The ink thus changes from a liquid phase to a vapor phase to rapidly generate a bubbling pressure to eject ink droplets through the ejection port 7 at a high speed. Thus, the ink jet print head 1 according to the present embodiment is of what is called a side chute type in which ink is ejected through the ejection port 7, formed in a surface parallel to the element substrate.

With reference to FIGS. 2 and 5A to 5D, the ejection port portion 6 according to the present embodiment and a peripheral structure thereof will be described in detail.

Figure 2:
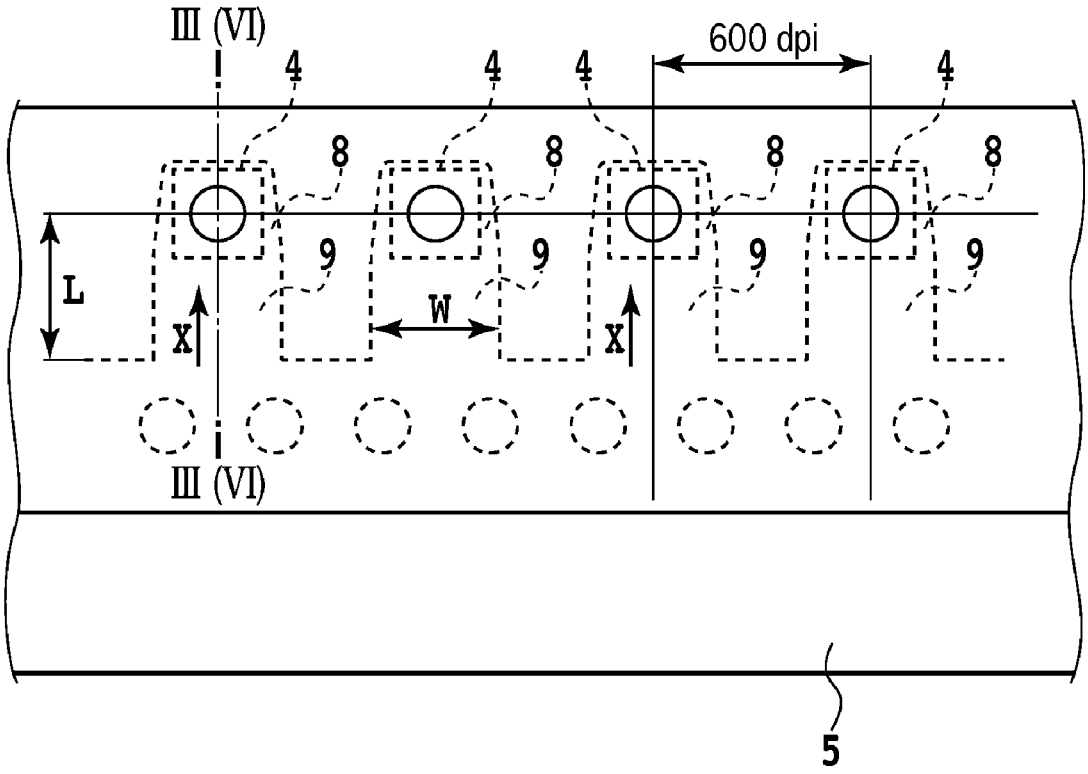
FIG. 2 is an enlarged plan view of a part of an ejection port array in the ink jet print head according to the embodiment of the present invention.

FIG. 2 is a partly enlarged plan view of one of the ejection port arrays on the ink jet print head according to the present embodiment; FIG. 2 shows the positional relationship between the ink supply channel 9, the electrothermal conversion element 4, and the ejection port 7. As shown in FIG. 2, the interval between the adjacent ejection ports 7 in each of the ejection port arrays (the pitch of the ejection ports) is set to allow dots to be formed at a density of 600 dpi. In FIG. 2, W denotes the width (channel width) of the ink supply channel in each of the nozzles in an ejection port arrangement direction. Furthermore, L denotes the length (channel length) from the center of the ejection port to an end of the ink supply channel, and X denotes a direction (ink supply direction) in which the ink flows through the ink supply channel.

Figure 3:
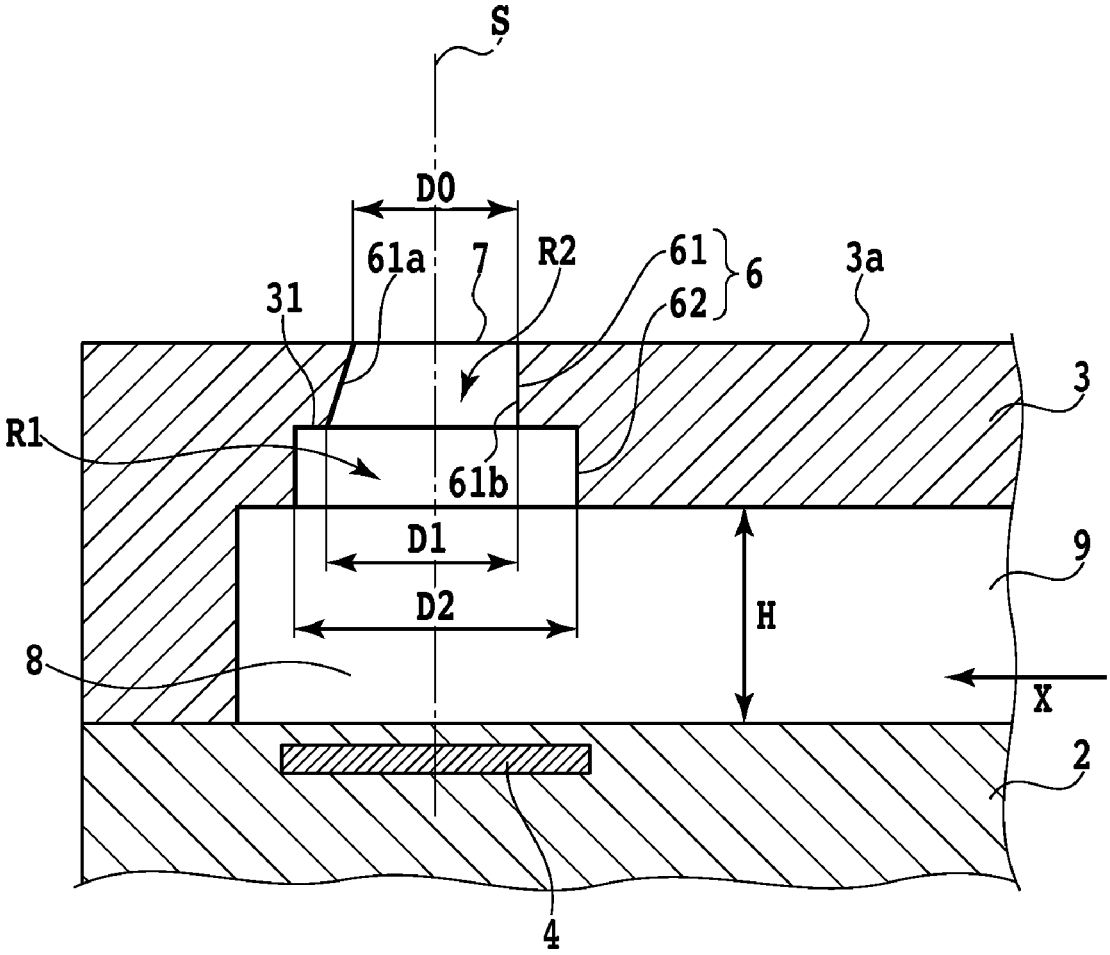
FIG. 3 is a vertically sectional side view of a nozzle shown in FIG. 2, the view being taken along line III-III in FIG. 2 and showing the structure of the nozzle according to the first embodiment of the present invention.
Figure 4:
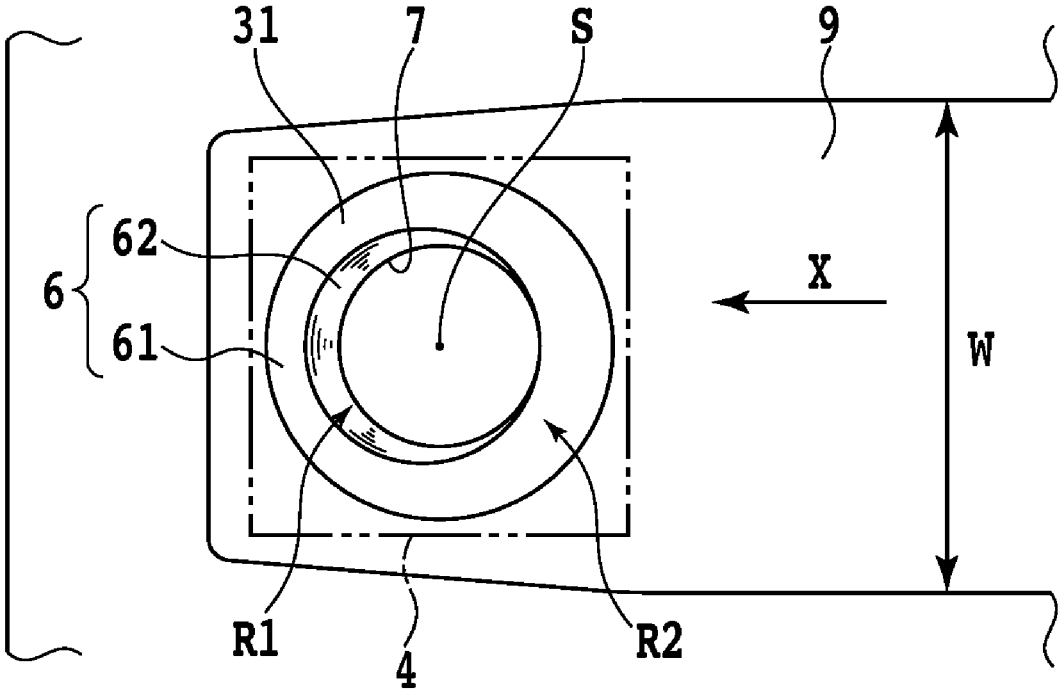
FIG. 4 is a bottom view of an ejection port portion shown in FIG. 3 as viewed from the side of an ink supply channel.

FIG. 3 is a vertically sectional side view of the nozzle shown in FIG. 2, the view being taken along line III-III in FIG. 2. FIG. 4 is a bottom view of the ejection port portion 6 in FIG. 3 as viewed from the side of the ink supply channel.

As shown in the figures, the ejection port portion 6, formed in the channel constituting substrate, is formed of a first ejection port portion 61 having the ejection port 7 at a first end, and a second ejection port portion 62 having a first end communicating with a second end of the first ejection port portion 61 and a second end communicating with the bubbling chamber 8, formed at the end of the ink supply channel 6. The ejection port 7 is formed opposite the heating element 4. The center of the ejection port 7 aligns with an axis (central axis S) passing through the center of the heating element 4 orthogonally to the major surface 2*a* of the element substrate.

A surface 3*a* of the channel constituting substrate 3 in which the ejection port 7 is formed is parallel to the major surface 2*a* of the element substrate.

Furthermore, the second ejection port portion 62 forms a cylindrical space and has a diameter D2 formed larger than the opening diameter D1 of the first ejection port portion at the second end thereof. Consequently, a step portion 31 is formed on an inner surface of the ejection port portion 6 at a boundary portion between the first ejection port portion 61 and the second ejection port portion 62. Furthermore, the ejection port portion 6 is configured such that the flow resistance to ink flowing through an area or region R1 located inward from the central axis S in the ink supply direction is higher than that to ink flowing through an area or region R2 located outward from the central axis S in the ink supply direction.

That is, as shown in the vertically sectional side view in FIG. 3, the first ejection port portion 61 according to the present embodiment is tapered such that the distance between an inner surface portion 61*a* located inward in the ink supply direction and the central axis S decreases toward the ejection port 7 side. In other words, a cross section (a plane orthogonal to the axis S (the plane parallel to the major surface 2*a* of the element substrate)) of the area R1 in the first ejection port portion 61, located inward in the ink supply direction, increases gradually from the opening end of the ejection port 7 to the second ejection port portion-side end 62 thereof. In the present embodiment, each of the ejection port portions is formed so as to have a circular cross section at any position of the ejection port portion. Reference α denotes the taper angle of the inner surface 61*a*.

In contrast, the inner surface portion 61*b* of the ejection port portion 61 according to the present embodiment, located outward in the ink channel, is formed so as to maintain the distance between the inner surface portion 61*b* and the central axis S constant or to have a smaller taper angle than the inner surface portion 61*a*. Thus, the area R2 in the first ejection port portion 61, located outward in the ink supply direction, has a smaller volume than the area R1 in the first ejection port portion 61, located inward in the ink supply direction. Thus, the flow resistance to the ink in the area R1 is lower than that in the area R2.

The configuration of the ejection port portion 6 is useful for providing an ink jet print head ejecting small droplets at a high frequency. For example, the configuration is very useful for a high-frequency nozzle exhibiting an ejection amount of at most 5 pl and an ejection frequency of at least 15 KHz, particularly, a nozzle exhibiting an ejection amount of about 3 pl and an ejection frequency of 30 KHz. In this case, desirably, the diameter of the ejection port 7 is about 10 to 15 μm, the diameter of the second ejection port portion is about 15 to 25 μm, the channel width is about 20 to 30 nm, the channel height is about 10 to 20 μm, and the channel length is about 25 to 40 μm. Furthermore, desirably, the taper angle of the supply-channel inward side of the first ejection port portion in a vertically sectional side view, as viewed from a direction perpendicular to the ink flow direction is about 5 to 20°, and the taper angle of the supply-channel outward side is about −5 to 5°. The central axis of the energy generating element desirably aligns with the central axis of the ejection port 7. However, the two central axes may be misaligned owing to a manufacturing error or the like. No problem occurs provided that the error is, for example, about ±1 nm.

Figure 5A:
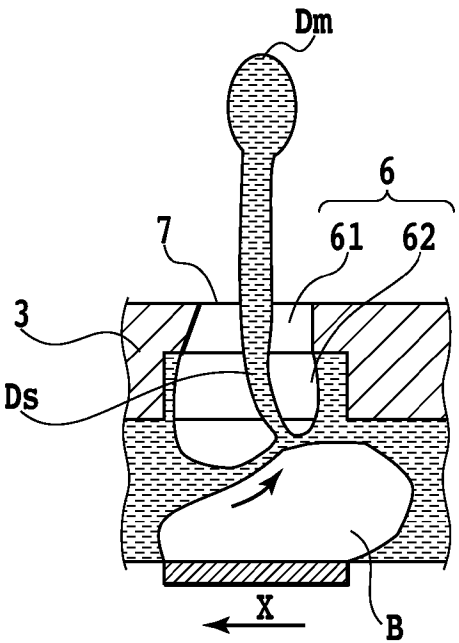
FIGS. 5A to 5D are vertically sectional side views illustrating the condition of a trailing portion formed when an ink droplet is ejected through the nozzle shown in FIG. 2.
Figure 5B:
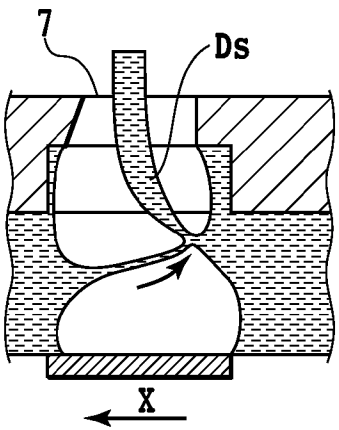
Figure 5C:
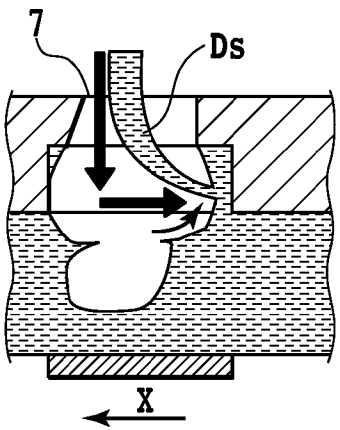
Figure 5D:
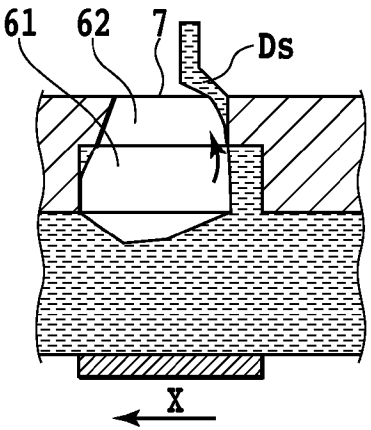

In the ink jet print head, when the electrothermal conversion element 4 generates heat and thus bubbles in the ink filled into the bubbling chamber 8 and the ejection port portion 6 via the ink supply channel 9, the ink in the bubbling chamber 8 and the ejection port portion 6 is pushed substantially toward the ejection port. At this time, the flow resistance to the ink flowing through the ejection port portion 6 is lower in the area R1, located inward in the ink channel, than in the area R2, located outward in the ink channel. Thus, the ink is likely to flow from the area R1 to the area R2. Consequently, two flows of the ink occur in the ejection port portion 6: a flow of the ink toward the ejection port 7 along the central axis S and a flow of the ink from the area R1 to the area R2, that is, in a direction crossing the central axis S. Thus, while the bubble B is becoming smaller as shown in FIGS. 5A to 5C, a trailing portion Ds continuous with a main droplet Dm ejected through the ejection port 7 bends rapidly in the ejection port portion 6, outward in the ink supply direction. The inner surface of the ejection port portion 6 located outward in the ink supply direction interferes with the trailing portion Ds (see FIG. 5D). As a result, the trailing portion D of the ejected ink droplet is cut early to reduce the entire length of the ink droplet. This enables a reduction in possible satellites and mist.

Thus, even if the height H and channel width W of the ink supply channel are increased to reduce the time required to refill the ink into the nozzle and the volume of the ejection port portion is increased to reduce the flow resistance to the ink during ejection, possible satellites and mist can be reduced. Thus, the present embodiment can sharply reduce problems such as contamination in the printing apparatus, degradation of image quality, and malfunctioning of the printing apparatus which are caused by satellites and mist.

Second Embodiment

Figure 6:
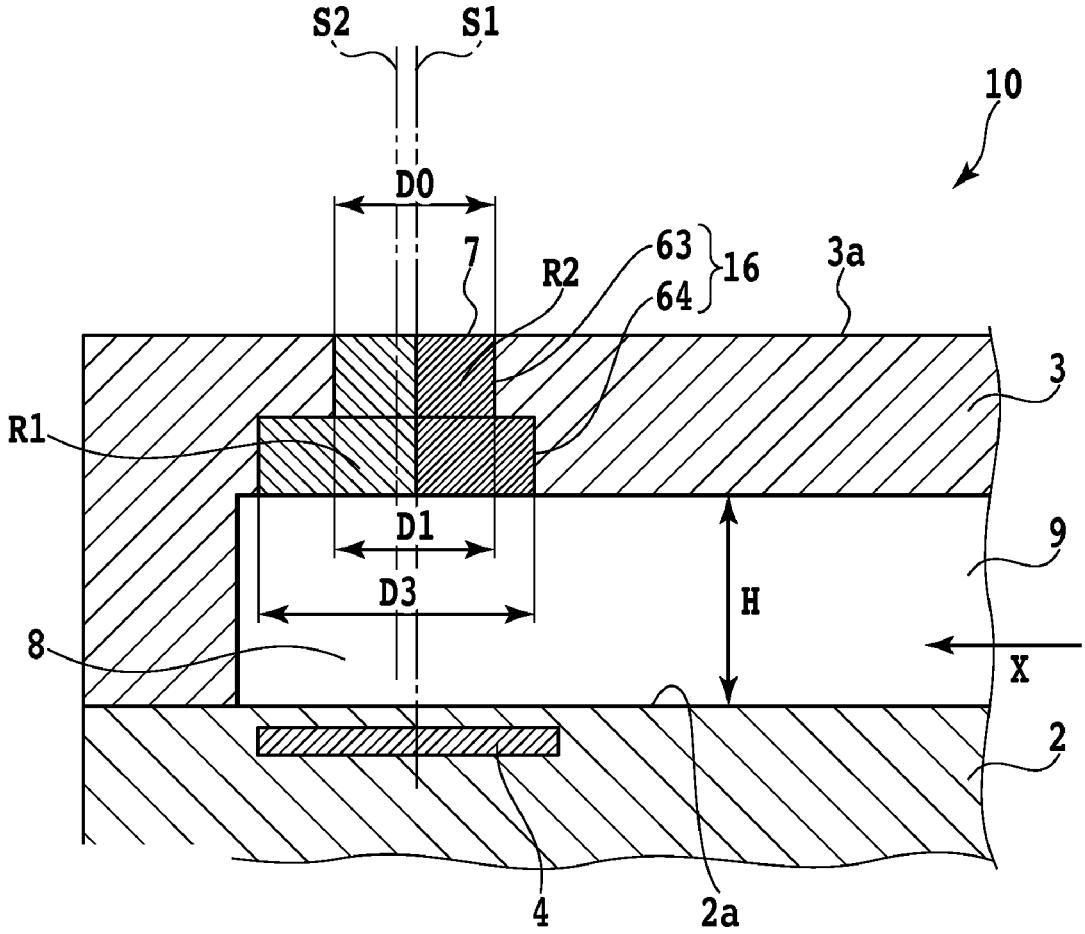
FIG. 6 is a vertically sectional side view of a nozzle shown in FIG. 2, the view being taken along line VI-VI in FIG. 2 and showing the structure of the nozzle according to a second embodiment of the present invention.
Figure 7:
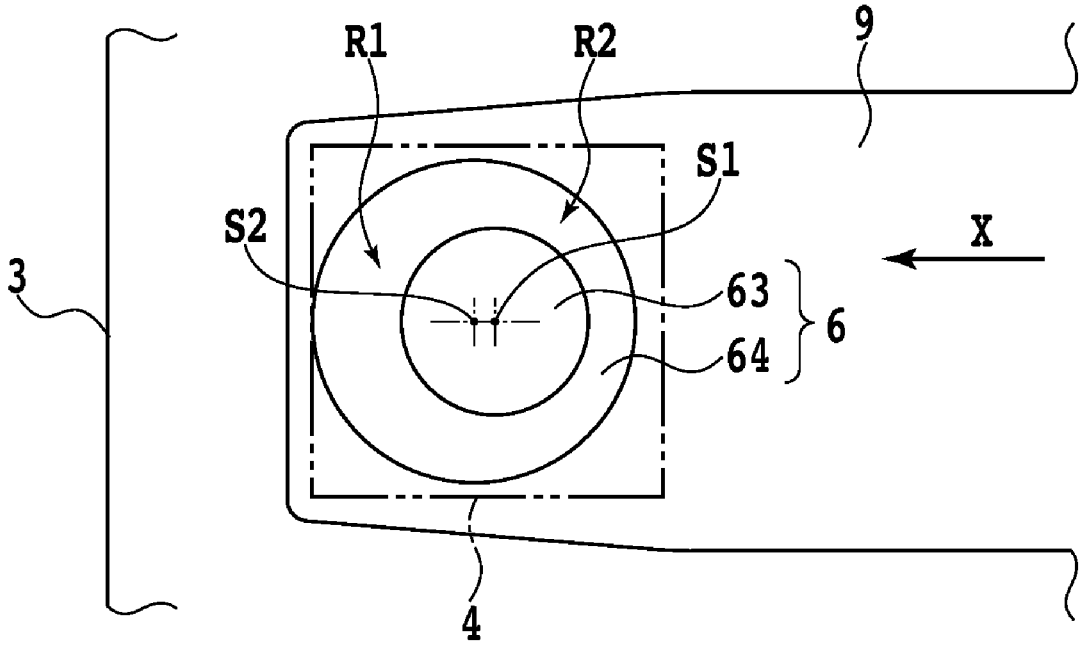
FIG. 7 is a bottom view of an ejection port portion shown in FIG. 6 as viewed from the side of an ink supply channel.
Figure 8:
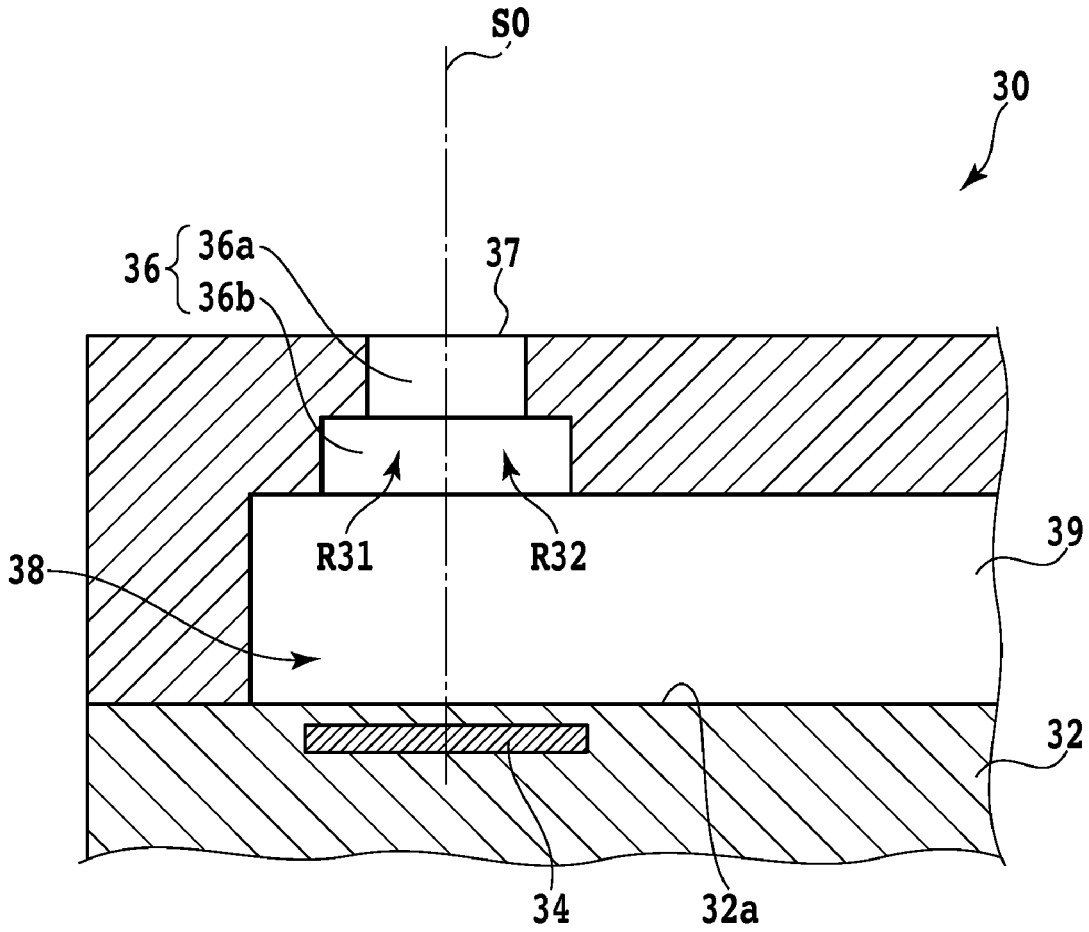
FIG. 8 is a vertically sectional side view showing the structure of a nozzle in a conventional ink jet print head.
Figure 9A:
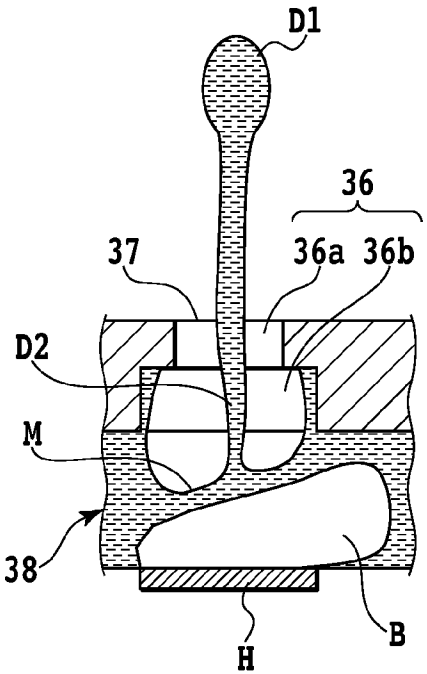
FIGS. 9A to 9D are vertically sectional side views illustrating the condition of a trailing portion formed when an ink droplet is ejected through the nozzle shown in FIG. 8.
Figure 9B:
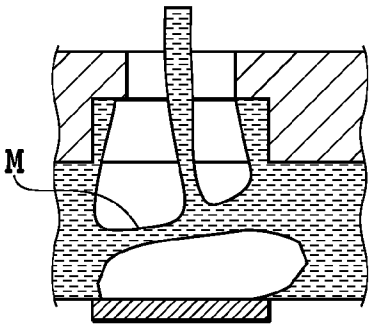
Figure 9C:
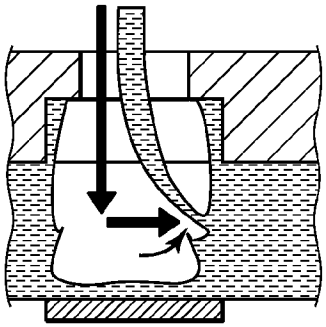
Figure 9D:
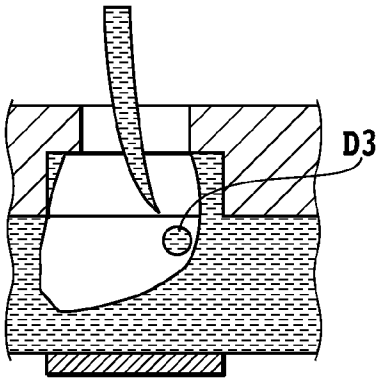

A second embodiment of the present invention will be described with reference to FIGS. 6 and 7.

The ink jet print head 10 according to the second embodiment has the same basic structure as that of the ink jet print head 10 according to the first embodiment. The ink jet print head 10 according to the second embodiment has the structure shown in FIGS. 1A, 1B, and 2. Thus, the same components in FIGS. 6 and 7 as those shown in FIGS. 1A, 1B, and 2 or components in FIGS. 6 and 7 corresponding to those shown in FIGS. 1A, 1B, and 2 are denoted by the same reference numerals. FIG. 6 is a vertically sectional side view of the nozzle in FIG. 1, the view being taken along line VI-VI in FIG. 1. FIG. 7 is a bottom view of the ejection port portion shown in FIG. 6 as viewed from the side of the ink supply channel.

In the ink jet print head 10 according to the second embodiment, the shape of the ejection port portion 16, formed in the channel constituting member 3, is different from that in the ink jet print head 1 according to the first embodiment. That is, the ejection port portion 16 according to the second embodiment is similar to that according to the first embodiment in that the ejection port portion 16 is made up of a first ejection port portion 63 including the ejection port portion 7, a second ejection port portion 64 having a first end communicating with the ejection port portion 63 and a second end communicating with the bubbling chamber 8. However, the second embodiment is different from the first embodiment in the following respect. That is, the first ejection port portion 63 forms a cylindrical space centered around a central axis (hereinafter referred to as a first central axis) passing through the center of the electrothermal conversion element 4 orthogonally to the major surface 2*a* of the element substrate at right angles. Furthermore, the second ejection port portion 64 forms a cylindrical space centered around a second central axis set parallel to the first central axis S1 and at a predetermined distance inward from the first central axis S1 in the ink supply direction. The second ejection port portion 64 has an inner diameter D3 larger than the inner diameter D1 of the first ejection port portion 63. Consequently, the present embodiment enables a reduction in the flow resistance to the ink in the ink ejection port portion 16 compared to the case in which the peripheral portion of the ejection port 7 is provided with a high strength on the basis of the thickness of the first ejection port portion 63 and in which the inner diameter of the ejection port portion 16 is set equal to that of the ejection port 7.

Furthermore, the second central axis S2 is a straight line set inward from the first central axis S1 in the ink supply direction. Thus, the area R1, located inward in the ink supply direction, has a larger volume than the area R2, located outward in the ink supply direction. The flow resistance to the ink in the area R1 is lower than that in the area R2.

The second embodiment is also useful for an ink jet print head exhibiting an ejection amount of at most 5 pl and an ejection frequency of at least 15 KHz, particularly, an ink jet print head exhibiting an ejection amount of about 3 pl and an ejection frequency of 30 KHz. In this case, desirably, the diameter of the ejection port 7 is about 10 to 15 μm, the diameter of the second ejection port portion is about 15 to 25 μm, the channel width is about 20 to 30 nm, the channel height is about 10 to 20 μm, and the channel length is about 25 to 40 μm. Furthermore, desirably, the distance between the second central axis S1 and the first central axis S2 is set to about 2 to 4 μm.

Also in the second embodiment, since the area R1, located inward in the ink channel, is smaller than the area R2, located outward in the ink channel, the ink is likely to flow from the area R1 to the area R2. Thus, two flows of the ink occur in the ejection port portion 6: a flow of the ink toward the ejection port 7 along the central axis S and a flow of the ink from the area R1 to the area R2. The trailing portion DS continuous with the main droplet bends rapidly in the ejection port portion 6, outward in the ink supply direction. As a result, the inner surface of the ejection port portion 6, located outward in the ink supply direction, interferes with the trailing portion DS, which is thus cut early to reduce the entire length of the ink droplet. This enables a reduction in possible satellites and mist accompanying the rear end of the ink droplet.

Furthermore, in the second embodiment, the first ejection port portion 63 and the second ejection port portion 64 may each be formed to be cylindrical and can thus be manufactured more easily than the first ejection port portion 61 according to the first embodiment, which is tapered.

Other Embodiments

In the above-described embodiments, each of the first and second ejection port portions has a circular cross section (the shape of the ejection port portion obtained by cutting the ejection port potion by a plane parallel to the major surface of the element substrate). However, the present invention is not limited to this aspect. The cross section of each of the first and second ejection port portions may have a different shape and may be, for example, elliptical or polygonal. The ejection port portions according to the present invention may have any shape provided that the flow resistance to the ink is lower in the area located inward in the ink supply direction than in the area located outward in the ink supply direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-231439, filed Sep. 6, 2007, which is hereby incorporated by reference herein in its entirety.

What is claimed is:

1. An ink jet print head comprising a nozzle having an ink supply channel through which ink is supplied, a bubbling chamber communicating with the ink supply channel and having an energy generating element disposed therein, an ejection port formed opposite the energy generating element so as to eject ink, and an ejection port portion that allows the ejection port formed opposite the energy generating element to communicate with the bubbling chamber, wherein the ejection port portion comprises an asymmetric structure that causes a flow resistance to ink to be lower in an entire region of the ejection port portion which is positioned inwardly from a center of the ejection port relative to an ink supply direction of ink flowing along the ink supply channel than in an entire region of the ejection port portion which is positioned outwardly from the center of the ejection port.

2. The ink jet print head according to claim 1, wherein the region of the ejection port portion which is positioned inwardly from the center of the ejection port relative to the ink supply direction of ink flowing along the ink supply channel has a larger volume than a volume of the area of the ejection port portion which is positioned outwardly from the center of the ejection port.

3. The ink jet print head according to claim 1, further comprising:

a first ejection port portion that forms a space communicating with the ejection port; and a second ejection port portion that forms a space that allows the first ejection port portion and the bubbling chamber to communicate with each other, wherein an opening in the second ejection port portion is positioned outside an opening in the first ejection port portion.

4. The ink jet print head according to claim 3, wherein the second ejection port portion forms a cylindrical space centered around a central axis passing through a center of the ejection port orthogonally to a surface in which the ejection port is formed.

5. The ink jet print head according to claim 1, wherein the region of the ejection port portion which is positioned inwardly from the center of the ejection port relative to the ink supply direction of ink flowing along the ink supply channel has a tapered cross-section that decreases in a direction toward the ejection port.

6. The ink jet print head according to claim 3, wherein the first ejection port portion forms a cylindrical space centered around a first central axis passing through the center of the ejection port orthogonally to the surface in which the ejection port is formed, and the second ejection port portion forms a cylindrical space centered around a second central axis set parallel to the first central axis and inwardly from the first central axis relative to the ink supply direction.

7. The ink jet print head according to claim 3, wherein the first ejection port portion and the second ejection port portion form a polygonal space.

8. The ink jet print head according to claim 3, wherein the first ejection port portion and the second ejection port portion form an elliptical space.

* * * * *